United States Patent [19]

Cottell

[11] 4,377,391

[45] Mar. 22, 1983

[54] PRODUCTION OF FUEL

[76] Inventor: Eric C. Cottell, Private Rd., Bayville, N.Y. 11709

[21] Appl. No.: 194,117

[22] Filed: Oct. 6, 1980

Related U.S. Application Data

[63] Continuation of Ser. No. 915,854, Jun. 15, 1978, abandoned.

[51] Int. Cl.[3] ..... C10L 1/32; C10L 9/00

[52] U.S. Cl. ..... 44/51; 44/1 SR; 44/24

[58] Field of Search ..... 44/1 R, 24, 51; 208/8; 209/5; 241/20, 24

[56] References Cited

U.S. PATENT DOCUMENTS

| | | | |
|---|---|---|---|
| 3,577,337 | 5/1971 | Kessler et al. | 208/8 |
| 3,640,016 | 2/1972 | Lee et al. | 44/1 R |
| 3,941,552 | 3/1976 | Cottell | 431/2 |
| 4,052,169 | 10/1977 | Cole et al. | 44/1 R |
| 4,054,506 | 10/1977 | Hart, Jr. et al. | 208/11 LE |
| 4,126,426 | 11/1978 | Verschuur | 44/24 |
| 4,156,593 | 5/1979 | Tarpley, Jr. | 44/1 R |

FOREIGN PATENT DOCUMENTS

| | | | |
|---|---|---|---|
| 633063 | 12/1961 | Canada | 208/11 LE |

*Primary Examiner*—Carl F. Dees

[57] ABSTRACT

The production of fuel comprising an emulsion of coal particles, oil and water or a dispersion of coal and oil in which pyrites, ash and other impurities are removed from the coal particles and the particles reduced in size by forming a slurry of contaminated coal particles and water and exposing that slurry to violent sonic agitation to cause the impurities to be detached from the coal particles and the particles to be reduced in size. The coal and impurities are thereafter separated and the coal subsequently incorporated into a fuel. The process may also be used to separate other minerals which are bonded mechanically as distinct from chemically, to each other.

6 Claims, 1 Drawing Figure

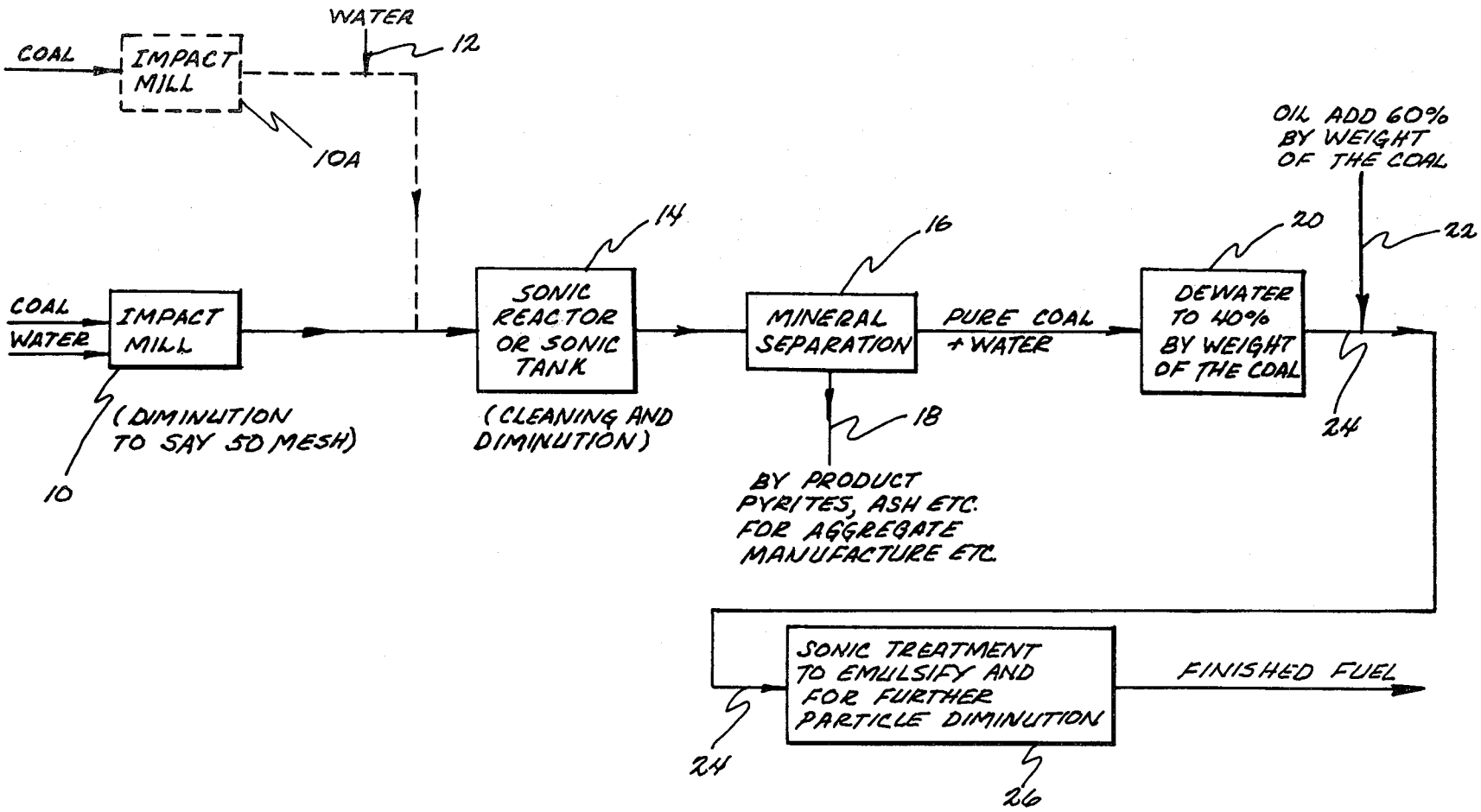
COAL
IMPACT MILL
10A
WATER
12
COAL
WATER
IMPACT MILL
(DIMINUTION TO SAY 50 MESH)
10
SONIC REACTOR OR SONIC TANK
(CLEANING AND DIMINUTION)
14
MINERAL SEPARATION
16
PURE COAL + WATER
BY PRODUCT PYRITES, ASH ETC. FOR AGGREGATE MANUFACTURE ETC.
18
DEWATER TO 40% BY WEIGHT OF THE COAL
20
OIL ADD 60% BY WEIGHT OF THE COAL
22
24
SONIC TREATMENT TO EMULSIFY AND FOR FURTHER PARTICLE DIMINUTION
26
24
FINISHED FUEL

PRODUCTION OF FUEL

This is a continuation of application Ser. No. 915,854, filed June 15, 1978, now abandoned.

BACKGROUND OF THE INVENTION

This invention is concerned with the separation of discrete minerals which are bonded together mechanically rather than on a molecular basis. The invention is particularly but not necessarily exclusively concerned with the separation of pyrites, ash and other impurities from coal in the production of a fuel comprising coal particles, oil and water. A fuel of the kind with which the invention is concerned is described in my U.S. Pat. No. 3,941,552 issued Mar. 2, 1976. In that patent the problems of contamination of the coal is discussed and it is proposed that there be incorporated into the fuel a quantity of lime to reduce objectionable emissions when the fuel is burned. The present invention is specifically directed to the removal, prior to combustion, of impurities contaminating the coal such as, for example, pyrites and ash forming constituents. The present invention additionally is concerned with the diminution of particle size prior to the incorporation of the particles into the fuel.

SUMMARY OF THE PRESENT INVENTION

The present invention provides a method of separating particulate discrete minerals bonded together mechanically by making a slurry of the particles and subjecting the resultant slurry to such intense vibrating action as to produce cavitation within the slurry and the separation of the different components of the particles. From another aspect, the present invention provides a method for producing fuel which comprises a mixture of coal, oil and water which method includes the step of mixing particles of coal and impurities with water to form slurry, exposing that slurry to such violent agitation as to cause cavitation so that the impurities are detached from the coal part of the particles. The method also includes the step of separating the detached impurities from the remaining coal constituents of the particles, and using those impurities as a by-product, for example, in the production of aggregates. The cleaned coal, if appropriate, after adjusting the water content of the resultant mixture of water and coal, is then mixed with oil and the mixture of coal, oil and water is treated to form an emulsion. Most desirably the treatment of the coal, oil and water to produce an emulsion is that described in my aforementioned patent. The resultant fuel can then be burned to produce energy as described, for example, in my aforementioned patent or as described in my co-pending application Ser. No. 873,301 filed Jan. 30, 1978.

The agitiation of the slurry of coal and water is most desirably effected sonically and the slurry is exposed to an energy density of at least 3 watts per $cm^2$ but in any event sufficient energy density in combination with a suitable frequency to cause cavitation and related to the range of particle size being treated.

DESCRIPTION OF THE DRAWINGS

The single FIGURE in the drawings is a flow chart showing the process part of the invention.

DESCRIPTION OF THE PREFERRED EMBODIMENT

In the process according to the invention, coal and water are delivered to an impact mill 10 or to some other appropriate grinding apparatus. Alternately, and as indicated in the chain line in the flow chart, coal may be delivered to an impact mill 10*a* and water is added to the coal particles exiting impact mill 10*a* as, for example, at 12 to form a slurry. The slurry exiting mill 10 or that produced by the addition of water to the particles exiting mill 10*a*, is delivered to a tank 14 within which the slurry is subject to violent agitation in this particular embodiment by irradiating the slurry with sonic energy. The sonic vibrations may be generated by known techniques, and particularly desirably the vibrations are generated by the utilization of equipment similar to that described in my aforementioned patent. Using a typical particle size of 50 to 100$\mu$ the suitable vibrations have been found to have a frequency of between 500 and 50,000 Hz and amplitudes ranging from about $2\times10^4$ to about 10$\mu$. The energy density should be of an order sufficient to produce effective cavitation within the volume of the slurry. It will be recognized that, dependent upon the density and other characteristics of the slurry particularly the physical characteristics of the coal particles, the energy requirements will vary.

The slurry is exposed to that radiation which will produce detachment of impurities bonded to the coal components of the particles and will simultaneously produce diminution of the particle size.

From the tank 14 the water and the coal and impurity components of the particles are delivered to a separation unit 16 in which the coal, pyrites and other impurities are separated. The denser impurities such as iron pyrites and silica are removed from the unit 16 as at 18 to be discarded or to be utilized in the manufacture of other products.

From unit 16 relatively pure coal and water is delivered to a dewatering unit 20 effective to reduce the quantity of the water in the slurry for further processing such as in my U.S. Pat. No. 3,941,552 or for feed stock, burning or other purposes.

When processed according to the teachings of my earlier patent oil is added at input 22 to the mixture being delivered along line 24 that oil being added in an amount equal to about 60% by weight of the coal. The resultant mixture of coal, oil and water is then delivered to a sonic treatment chamber 26 which conveniently is of the kind described in my aforementioned patent where the mixture is subject to violent agitation to produce cavitation and to produce a virtually stable emulsion.

It will be recognized that the particular form of the various components described hereabove may be varied to suit particular environments and in particular the mechanical mills, the dewatering and mineral separation the units may take any of a number of forms since the particular forms of those items, per se, do not constitute a part of the present invention.

It will be recognized that in certain instances after the contaminants have been separated from the coal, the coal may be dried thoroughly and mixed with oil to form a dispersion of coal and oil which may be burned as a fuel.

What is claimed is:

1. A method of producing fuel comprising forming a slurry consisting of a dispersion of particles of coal and impurities bonded to said coal and water, exposing the slurry to a sufficiently intense vibrating action to produce cavitation within the slurry and to mechanically detach the impurities from said coal and to reduce the size of the particles, mechanically separating detached impurities from the slurry, and partially reducing but not fully separating the water content of the slurry preparatory to the addition of oil to form a coal/oil/water fuel.

2. The method according to claim 1 wherein said agitation is produced by exposing said slurry to a sonic energy density level of at least 3 watts/cm$^2$.

3. The method of producing fuel according to claim 1 further comprising adding oil to the slurry of reduced water content and subjecting the resulting coal, oil and water mixture to violent agitation to produce cavitation.

4. A method of producing fuel comprising forming a slurry consisting of a dispersion of particles of coal and impurities bonded to said coal and water, exposing the slurry to violent agitation to produce cavitation within the slurry and to mechanically detach the impurities from said coal and to reduce the size of said particles, mechanically separating the detached impurities from the slurry and partially de-watering the coal/water slurry up to about 40% by weight of the coal, adding oil to the de-watered slurry and then subjecting the resulting coal, oil and water mixture to violent agitation to produce cavitation to produce a stable emulsion.

5. The method of producing fuel according to claim 4 wherein the oil is added to the de-watered slurry up to about 60% by weight of the coal.

6. A method of beneficiating coal having pyrities, ash, and other impurities bonded with the coal comprising:

(a) rendering coal to particles of less than 200 microns in diameter, (b) forming an aqueous solution consisting of said coal particles of less than 200 microns in diameter and water;

(c) then cavitating said slurry with intense agitation at a level of at least 15 joules/cm$^2$ to thereby further break the coal particles into smaller particles and to impregnate particles with water and;

(d) concentrating said slurry to a mixture having up to 40% water preparatory to further processing of the concentrated slurry.

* * * * *